US009629423B2

(12) United States Patent
Schlipper

(10) Patent No.: US 9,629,423 B2
(45) Date of Patent: Apr. 25, 2017

(54) ZIP FASTENER AND LUGGAGE

(71) Applicant: MRM HK LIMITED, Hong Kong (HK)

(72) Inventor: Robert Wesley Schlipper, Hong Kong (HK)

(73) Assignee: MRM HK LIMITED, Hong Kong (HK)

( * ) Notice: Subject to any disclaimer, the term of this patent is extended or adjusted under 35 U.S.C. 154(b) by 833 days.

(21) Appl. No.: 14/019,550

(22) Filed: Sep. 6, 2013

(65) Prior Publication Data

US 2014/0069757 A1 Mar. 13, 2014

(30) Foreign Application Priority Data

Sep. 7, 2012 (AU) ..... 2012903907

(51) Int. Cl.

| | |
|---|---|
| ***A44B 19/30*** | (2006.01) |
| ***A44B 19/24*** | (2006.01) |
| ***A44B 19/06*** | (2006.01) |
| ***A45C 13/10*** | (2006.01) |
| ***A44B 19/26*** | (2006.01) |

(52) U.S. Cl.

CPC ..... *A44B 19/06* (2013.01); *A44B 19/262* (2013.01); *A44B 19/301* (2013.01); *A45C 13/103* (2013.01); *Y10T 24/2509* (2015.01)

(58) Field of Classification Search

CPC ..... A45C 13/103; A44B 19/06; A44B 19/262; A44B 19/301

USPC ..... 24/386

See application file for complete search history.

(56) References Cited

U.S. PATENT DOCUMENTS 2,517,403 A * 8/1950 Morin ..... A44B 19/301 24/386
2,621,387 A * 12/1952 Williams ..... A44B 19/301 24/386
2,701,903 A * 2/1955 Williams ..... A44B 19/301 24/386
3,827,019 A * 7/1974 Serbu ..... A41F 1/002 135/117
3,852,851 A * 12/1974 Higuchi ..... A44B 19/301 24/387

(Continued)

FOREIGN PATENT DOCUMENTS

AU 2010201766 A1 11/2010
CN 102076240 A 5/2011

(Continued)

OTHER PUBLICATIONS

Chinese Search Report issued in CN Application No. 2013104042687, mailed Jun. 24, 2015, 1 page.

(Continued)

*Primary Examiner* — Robert J Sandy
*Assistant Examiner* — Jason W San
(74) *Attorney, Agent, or Firm* — Faegre Baker Daniels LLP

(57) ABSTRACT

A zip fastener includes two sliders for connecting elongate stringers, each slider having a pull tab. For improved security of the zip fastener the pull tabs can be interlocked with one another by a slide-and-turn action, turning one pull tab relative to the other about an axis extending in the longitudinal direction of the stringers. A luggage item includes a fastening device for locking the pull tabs together.

20 Claims, 10 Drawing Sheets

(56) References Cited

U.S. PATENT DOCUMENTS 3,965,706 A * 6/1976 Davis ..... A44B 19/301 190/120
4,081,882 A * 4/1978 Toepelt ..... A44B 19/301 24/386
4,350,375 A * 9/1982 Bako ..... A44B 19/301 24/386
4,578,966 A * 4/1986 Kasai ..... A44B 19/301 24/418
D291,652 S * 9/1987 Gisiger ..... D8/331
4,790,156 A * 12/1988 Yang ..... A44B 19/301 24/386
4,930,323 A * 6/1990 Terada ..... A44B 19/301 70/68
5,031,944 A * 7/1991 Keyaki ..... A44B 19/301 24/387
5,063,760 A * 11/1991 Horita ..... A44B 19/301 70/23
5,136,864 A * 8/1992 Spiekermann ..... A44B 19/301 70/312
5,557,954 A * 9/1996 Ling ..... E05B 37/12 70/312
5,682,653 A * 11/1997 Berglof ..... G09F 1/10 224/183
6,244,081 B1 * 6/2001 Schlipper ..... A45C 13/002 70/14
6,467,135 B1 * 10/2002 Schuster ..... A44B 19/262 24/381
6,510,593 B1 * 1/2003 Kim ..... A44B 19/301 24/382
7,073,233 B2 * 7/2006 Leva ..... A44B 19/26 24/386
7,516,523 B2 * 4/2009 Okot ..... A44B 19/262 24/382
7,533,451 B2 * 5/2009 Akashi ..... A44B 19/301 24/386
8,484,764 B2 * 7/2013 Damon ..... A44B 19/38 2/108
2003/0066170 A1 * 4/2003 Huang ..... A44B 19/301 24/387
2004/0237605 A1 * 12/2004 Lin ..... A44B 19/301 70/68
2005/0035605 A1 * 2/2005 Vanderwater-Piercy A44B 19/301 292/308
2005/0109072 A1 * 5/2005 Ling ..... A44B 19/301 70/68
2005/0257351 A1 11/2005 Pitts et al.
2006/0006035 A1 * 1/2006 Liang ..... A45C 13/18 190/101
2007/0214613 A1 * 9/2007 Shiao ..... A63B 55/00 24/303
2008/0196217 A1 * 8/2008 Eschbach ..... A44B 19/262 24/386
2008/0229554 A1 * 9/2008 Payne ..... A44B 19/30 24/418
2008/0252461 A1 * 10/2008 Sugata ..... G06K 7/10178 340/572.7
2009/0106951 A1 4/2009 Edwards et al.
2010/0170306 A1 * 7/2010 Fong ..... A44B 19/301 70/57
2012/0117765 A1 * 5/2012 Damon ..... A44B 19/38 24/405
2013/0061436 A1 * 3/2013 Peters ..... A44B 99/00 24/430
2015/0374075 A1 * 12/2015 Smith ..... A44B 19/30 24/418

FOREIGN PATENT DOCUMENTS

| | | | |
|---|---|---|---|
| CN | 201860936 | U | 6/2011 |
| CN | 201888334 | U | 7/2011 |
| CN | 103653566 | A | 3/2014 |
| EP | 1752057 | A2 | 2/2007 |
| EP | 2002744 | A1 | 12/2008 |
| EP | 2710915 | A2 | 3/2014 |
| GB | 2381830 | A | 5/2003 |
| JP | 6327117 | U | 2/1988 |
| WO | 2004008903 | A1 | 1/2004 |
| WO | 2007028197 | A1 | 3/2007 |
| WO | 2010070743 | A1 | 6/2010 |

OTHER PUBLICATIONS

European Search Report issued in EP Application No. 13004366.4, mailed Feb. 11, 2015, 7 pages.

* cited by examiner

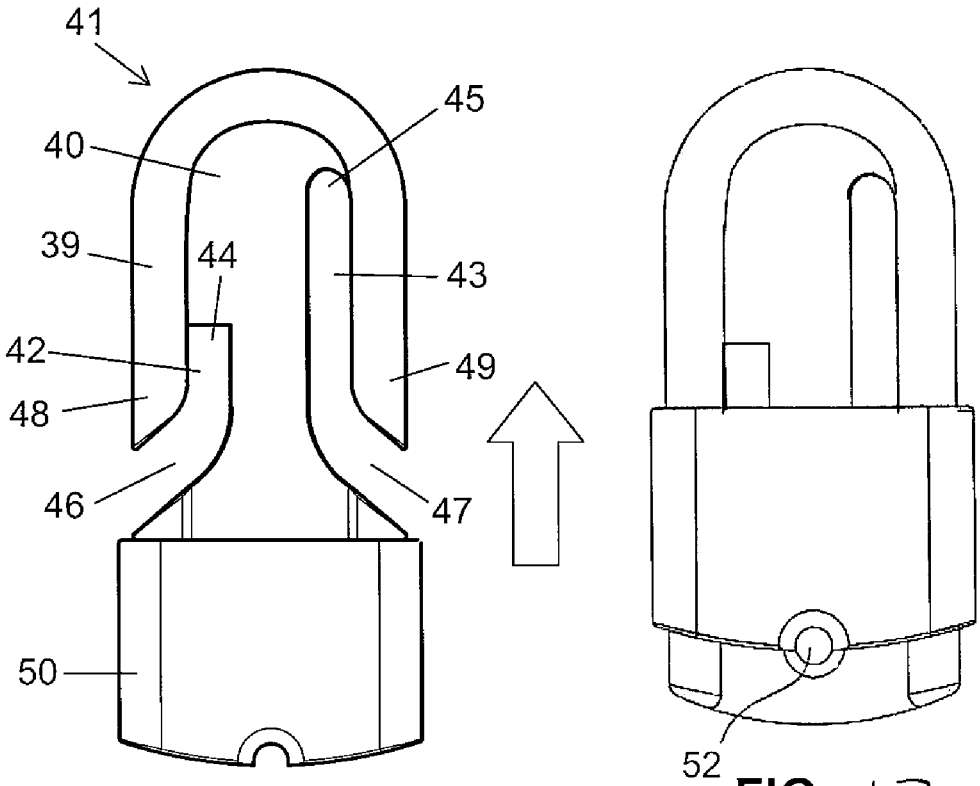
FIG. 12
FIG. 13
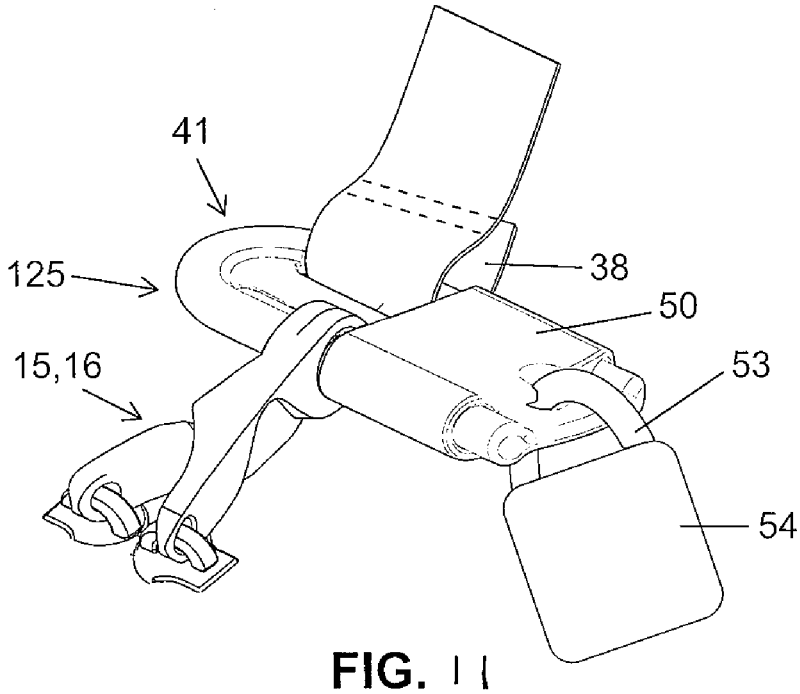
FIG. 11

ZIP FASTENER AND LUGGAGE

TECHNICAL FIELD

The present invention relates to zip fasteners with security features, and more particularly, to such zip fasteners having two moveable sliders that each mesh and unmesh the teeth of the fastener, allowing it be opened at any point along its length. The invention also relates to luggage, on which such zip fasteners may be provided.

BACKGROUND OF THE INVENTION

Zip fasteners with two sliders are often used in various applications where a degree of security is desirable. Locking or securing the zip fastener can be achieved by locking each of the sliders to a stationary fixture, or else by locking the two sliders together. Each zip slider may be connected to a proximal end of a pull tab, with an aperture being formed in the opposing distal end of the pull tab. This arrangement allows for a securing device, such as the shackle of a padlock or a cable tie, to be fixed through both of the apertures in the distal ends of the pull tabs, to thereby lock the two sliders together and secure the closure. Advantageously, two sliders connected in this manner can still readily be moved together along the stringers as desired, by grasping one or both of the connected pull tabs in the conventional way. In addition, on a luggage item for instance, it is known to provide a key or combination locking system which has a sliding pin that can be extended through the aperture in the distal end of a pull tab, for securing the slider to the luggage item in place.

One of the drawbacks of locking the distal ends of the pull tabs in place, or to one another, is that doing so does not ordinarily prevent the sliders being separated sufficiently to create a small opening. In some cases this poses a security risk, if a thief can insert his fingers into the opening and work the stringers through the stationary sliders to enlarge the opening. This problem has been addressed in some prior art tamper resistant zip fasteners by providing coupling parts on the sliders for locking the sliders themselves directly to one another, however, such solutions require the manufacture of special-purpose sliders with interlocking features, which makes this a more costly option.

The publications US20090106951 and US20050257351 both describe a type of zip fastener in which the pull tabs on respective sliders interlock with one another, and in which the proximal ends of the pull tabs are connected to the sliders by couplings permitting the pull tabs to rotate about an axis transverse to the longitudinal axis of the stringers. Relative rotation between the pull tabs about the transverse axis is needed to place them in their interlocked positions. A disadvantage of both of these zip fasteners is that although they provide some basic degree of security for the closure, neither includes any provision for a higher degree of security, as is achieved, for instance, by connecting the pull tabs with a padlock.

With the device of US20090106951 in its interlocked position the pull tab on each slider overlies the adjacent slider, such that the pull tabs are aligned longitudinally, face in opposite directions, and are generally coplanar and close to the slider. When interlocked, the pull tabs cannot be conveniently grasped, so this prevents the two sliders being readily be moved together along the stringers. In the device of US20050257351 one pull tab has a male and the other a female coupler, the axes of which are aligned longitudinally in the interlocked position. A drawback of this alignment is that, intuitively, a thief would tend to pull the pull tabs apart in the longitudinal direction to separate the sliders and open the zip fastener, so this arrangement would not defeat even the most quick or casual attentions of a thief.

It is an object of the present invention to overcome or substantially ameliorate the above disadvantages or, more generally, to provide an improved zip fastener and luggage.

DISCLOSURE OF THE INVENTION

According to one aspect of the present invention there is provided a zip fastener, comprising:

first and second sliders disposed to slide lengthwise along a pair of stringers, the sliders being moveable relative to one another between a closed position wherein the sliders are adjacent one another, and an open position in which the sliders are spaced apart to open the zip fastener;

first and second pull tabs, each on a respective one of the first and second sliders;

a first coupling connecting the first pull tab to the first slider for rotation about a pivot axis extending substantially in the lengthwise direction of the stringers;

the first pull tab having one of complementary male and female locking features, the second pull tab having the other of the complementary male and female locking features; such that with the sliders in the closed position, rotation of the first pull tab about the pivot axis mutually engages the male and female locking features to interlock the first and second pull tabs in an interlocked position that prevents movement of the sliders to their open position.

Preferably the first and second pull tabs each have a body elongated between opposing proximal and distal ends, openings are provided in each distal end, and the openings in the distal ends are in registration with one another in the interlocked position.

Preferably the first and second pull tabs each have a body elongated between opposing proximal and distal ends, at least one of the first and second pull tabs includes a hook disposed between its proximal and distal ends, a tip of the hook being spaced from the body, such that the female locking feature comprises a recess between the body and the tip of the hook, and the male locking feature comprises at least a complementary part of the body of the other of the first and second pull tabs, which complementary portion may be received in the recess.

Preferably opposing inner surfaces of the recess are substantially planar, and opposing outer surfaces of the complementary portion of the body received in the female locking feature are substantially planar.

Preferably the first and second pull tabs are of like form.

Preferably each pull tab has a respective outermost surface disposed outermost when the first and second pull tabs are in their interlocked position, and a concavity in each outermost surface that bounds the complementary portion of the body received in the recess, such that in the interlocked position, said outermost surfaces are substantially aligned coplanar with a respective outer surface of the tip of the hook.

Preferably openings are formed at the proximal ends, the first and second sliders each including a loop extending substantially in the lengthwise direction through the openings at the proximal ends, the loop on the first slider and the opening in the proximal end of the first pull tab forming the first coupling, and the loop on the second slider and the opening in the proximal end of the second pull tab forming a second coupling.

Preferably the tip of the hook is sized or formed such that it cannot mistakenly be inserted into the recess and the openings in the distal ends aligned.

Preferably the hook is integral with the body, and includes a flange portion connecting the tip to the body, the flange portion extending from an edge of the body.

Preferably further comprising a detent for holding the male and female locking features in mutual engagement. The detent may comprise a magnet received in an aperture in the male locking feature, or a snap connection.

In another aspect of the invention there is provided luggage comprising at least one zip fastener as described above, and further including a fastening device for connecting the first and second pull tabs.

The fastening device may include: a body fixed to the luggage, the body having at least one pin portion having a projecting free end and an opposing fixed end, the in portion being configured to be received in the openings in the distal ends, and a closure engaged with the body for sliding movement between a closed position in which the closure blocks the free end and an open position in which the closure is spaced apart from the free end.

Preferably the body further comprises an opening positioned such that with the closure in the closed position a shackle of a padlock extending through the aperture secures the closure.

Preferably at least one zip fastener comprises two zip fasteners, and the fastening device is fixed to the luggage between the two zip fasteners. This invention thus provides a zip fastener device and bag with improved security, without the complexity and consequent high manufacturing costs of many of the prior art solutions.

BRIEF DESCRIPTION OF THE DRAWINGS

Preferred forms of the present invention will now be described by way of example with reference to the accompanying drawings, wherein:

FIG. 11 is a perspective view of a fastening device for use with the zip fastener and a strap;

FIGS. 12 and 13 are plan views of the fastening device of FIG. 11 in open and closed positions respectively;

FIG. 18 is an end view of a latching member of the fastening device of FIG. 17, and FIG. 19 is a perspective view of a backpack fitted with a zip fastener and the fastening device of FIG. 17 shown in a closed position.

DESCRIPTION OF THE PREFERRED EMBODIMENTS

Figure 1:
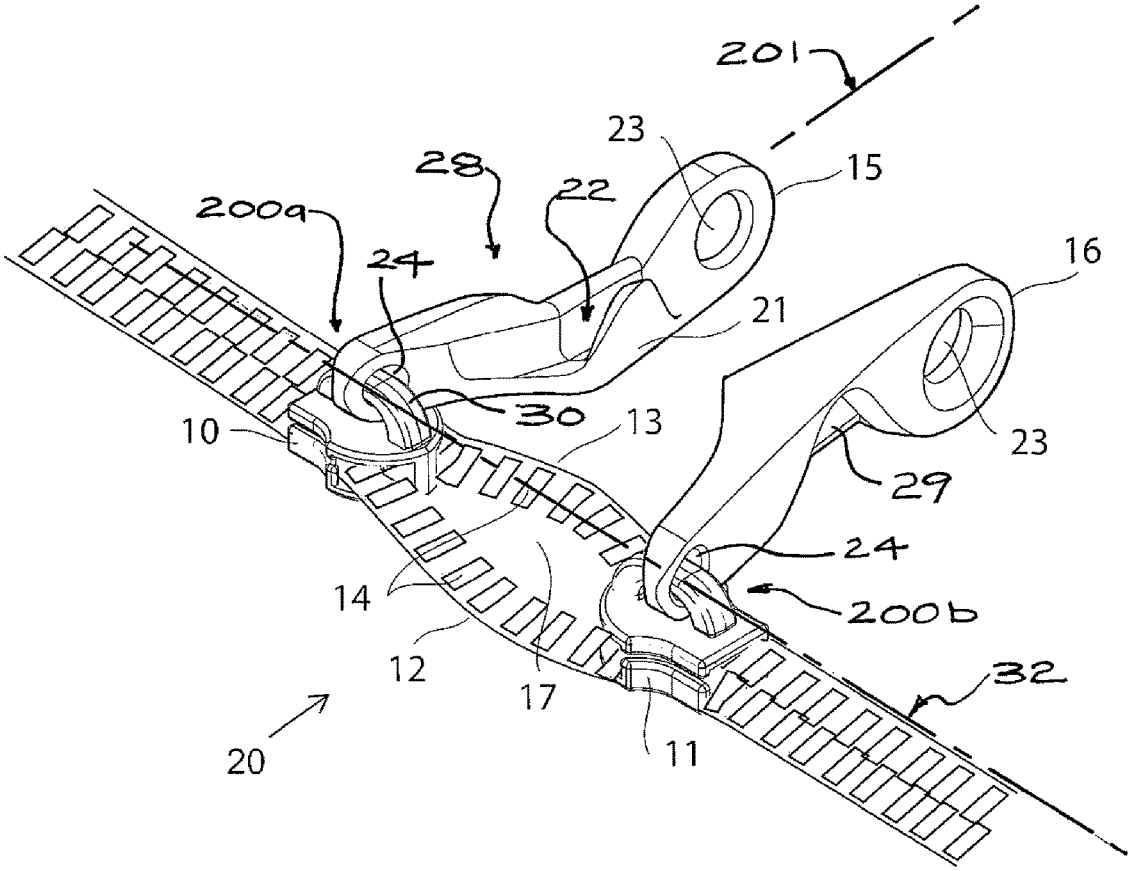
FIG. 1 is a perspective view of a zip fastener of a first embodiment of the invention in an open position.
Figure 2:
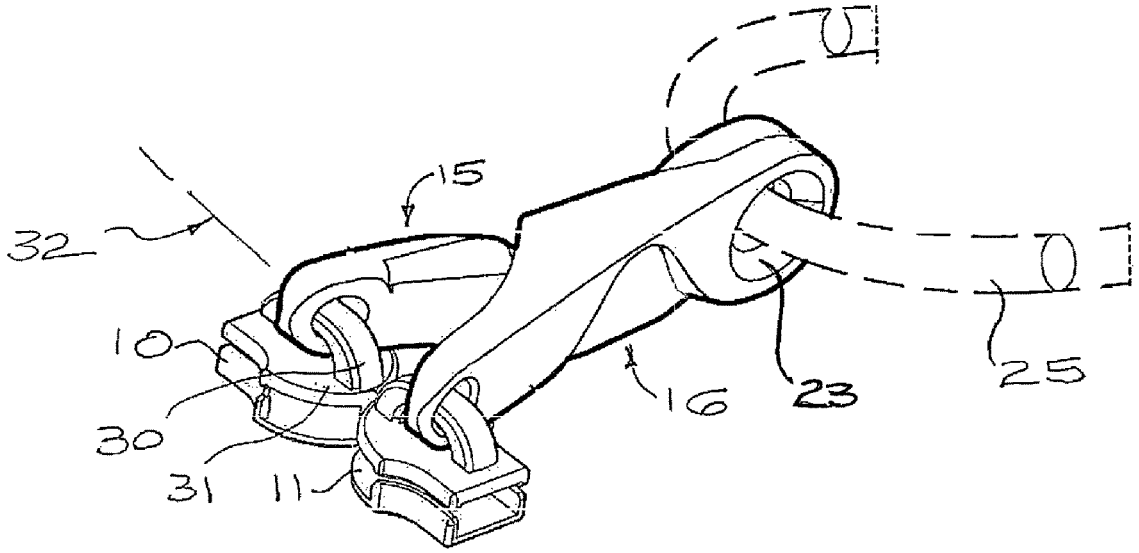
FIG. 2 is a perspective view of the zip fastener of FIG. 1 in a closed position.

Referring to FIGS. 1 to 6, a first embodiment of a zip fastener 20 generally comprises a first slider 10, and a second slider 11 both engaged with a pair of stringers 12, 13 which may be connected together by means of meshed teeth 14, in the well known manner. Additionally, two pull tabs 15, 16 are provided, one may be connected to each of the sliders, to allow for improved purchase for the user to pull the sliders 10, 11 along the stringers 12, 13. Relative movement between the sliders 10, 11 along the stringers 12, 13 opens and closes the zip fastener or, more specifically, opens and closes an opening 17 between the stringers 12, 13 and sliders 10, 11.

A first coupling 200*a* connects the proximal end of the first pull tab 15 to the first slider 10, and second coupling 200*b* connects the second pull tab 16 to the second slider 11. The couplings 200*a*, 200*b* allow the pull tabs 15, 16 to rotate about a pivot axis 32 extending substantially in the lengthwise direction of the stringers 12, 13. The proximal ends of the pull tabs 15, 16 may be fixed to the sliders 10, 11 loop 30 fixed to a top plate 31, the loops 30 extending generally in the lengthwise direction of the stringers. The loops 30 and proximal end openings 24 in the pull tabs 15, 16 in which the loops 30 are received provide the two parts of the couplings 200*a*, 200*b* which, in addition to other movements, allows relative rotation between the sliders 10, 11 and the pull tabs 15, 16 about pivot axis 32.

The pull tabs 15, 16 each have a body 28 generally elongated in the direction of long axis 201 between opposing proximal and distal ends, with openings 23 provided in each distal end. The pull tabs 15, 16 have complementary male and female locking features, exemplified in the first embodiment by a female locking feature in the form of recess 22 formed by a hook 21 on the first pull tab 15. The recess 22 receives a male complementary part 29 on the body of the second pull tab 16. In this manner when the zip is closed, as by moving the sliders 10, 11 from the separated position (shown in FIG. 1) to the position where they are adjacent one another, rotation of the first pull tab 15 about the longitudinal axis 32 to an interlocked position (shown in FIG. 2) interlocks the pull tabs 15, 16. This slide-and-turn action, whereby the pull tabs are pushed together, and one turned relative to the other about longitudinal axis 32, interlocks the pull tabs 15, 16 with one another, in which position they may be held against rotation about axis 32 by a detent (not shown in FIGS. 1-6). When thus interlocked the openings 23 in the distal ends are in registration with one another, such that a fastening device 25 (FIG. 2) passing through the distal end openings 23 prevents relative rotation between the pull tabs 15, 16 about axis 32. In this interlocked position, the engagement between the male and female locking features hinders separation of the sliders 10, 11 required to move them to their open position and the tabs 15, 16 are restrained to rotate together about the longitudinal axis 32, but are no longer able to rotate about a transverse axis. Of course, the pull tabs 15, 16 are also prevented from relative rotation about the fastening device 25 or the common axis of openings 23, owing to the engagement between the sliders 10, 11 and the stringers 12, 13.

Figure 3:
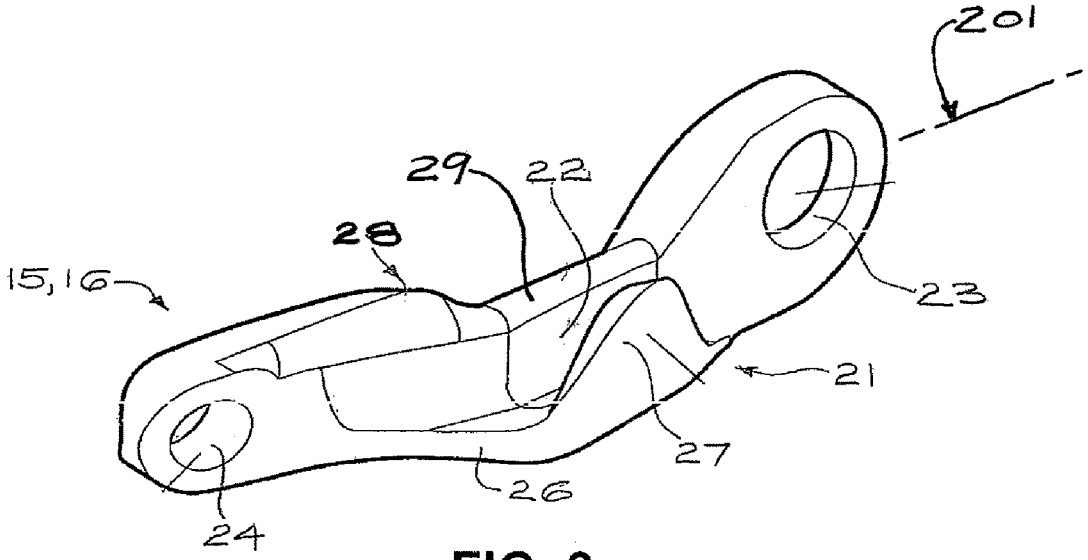
FIG. 3 is a perspective view of pull tab of the zip fastener of FIG. 1.
Figure 4:
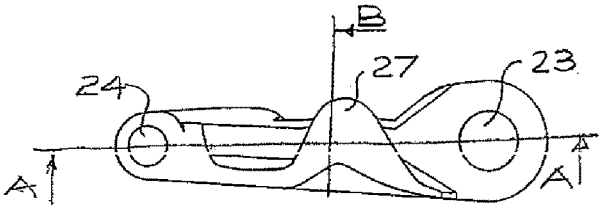
FIG. 4 is a side elevation of the pull tab of FIG. 3.

In preferred embodiments of the invention the first and second pull tabs 15, 16 are of like form, thus reducing the number of different parts making up the zip fastener. With particular reference to FIG. 3, the proximal end opening 24 in the proximal end and the distal end opening 23 in the opposing distal end both extend generally transversely through the elongate body 28. The hook 21 is located between the proximal and distal ends, and may project to one side of the main body 28, with which it may be integral. The hook 21 may include a flange portion 26 projecting transversely from the main body 28, and a tip 27 laterally spaced from the elongate body 28 to define the recess 22. The tip 27 of the hook 21 may have a convex or rounded form. The flange portion 26 may be tapered in the longitudinal direction between the main body 28 and the tip 27. The tip 27 and the female locking feature or recess 22 are preferably elongate, and may be elongated in a direction generally aligned with the longitudinal axis 201 of the pull tabs. The main body 28 may have a longitudinally stepped form, with a central section 29 offset transversely to a first side from the adjacent proximal ends, the hook 21 being offset to the first side of the central section 29.

Figure 5:
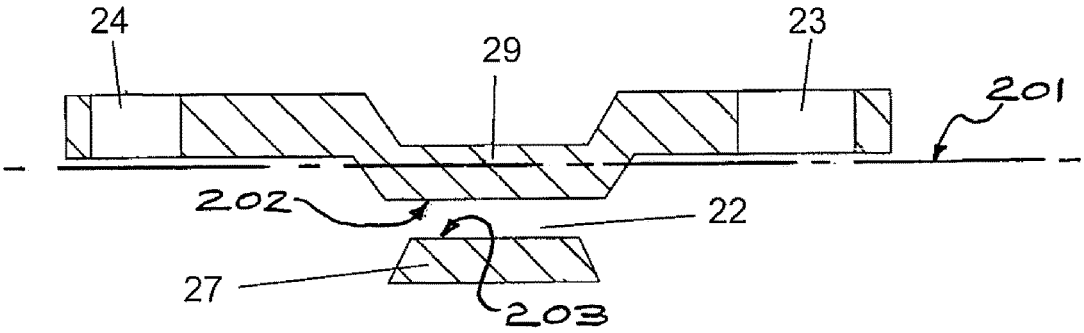
FIGS. 5 and 6 are sections indicated by lines AA and BB in FIG. 4 respectively.
Figure 6:
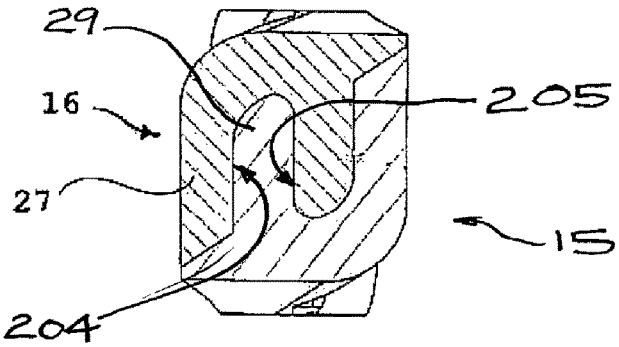

As best seen in FIGS. 5 and 6, opposing inner surfaces 202, 203 of the recess 22 are substantially planar, and opposing outer surfaces 204, 205 of the complementary portion 29 of the body that received in the recess 22 are substantially planar, and extend in the direction of long axis 201, or at an acute angle to the longitudinal axes 201.

Figure 7A:
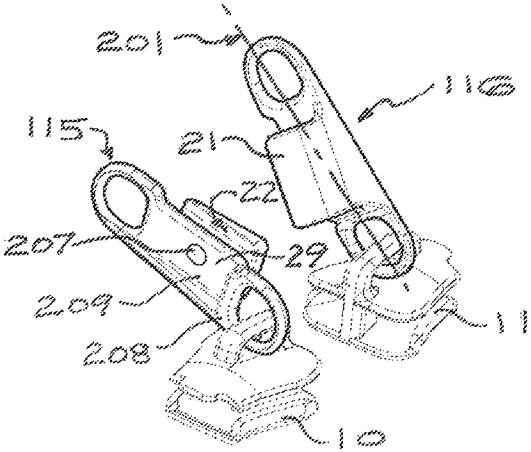
FIGS. 7*a*, 7*b* and 7*c* are pictorial views of a second embodiment of the zip fastener of the invention, showing the pull tabs separated, partially engaged, and interlocked respectively.
Figure 7B:
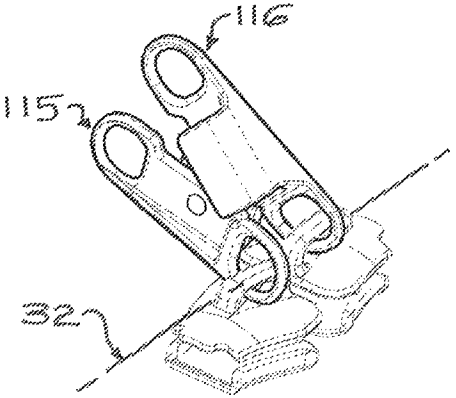
Figure 7C:
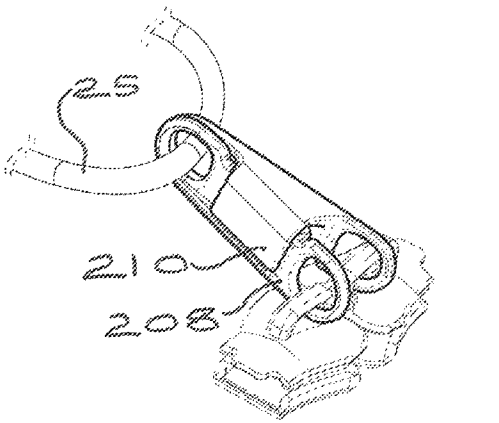

FIGS. 7*a*-7*c* illustrate a second embodiment which is generally like the first embodiment except the shape of the tip 21, which has a rectangular form with its long side generally aligned in the direction of the long axis 201. A detent for holding the male and female locking features in mutual engagement in the interlocked position (FIG. 7*c*) comprises a permanent magnet 207 received in an aperture in the male locking feature or body portion 29 of each of the pull tabs 115, 116. Each pull tabs 115, 116 has a respective outermost surface 208 disposed outermost when the first and second pull tabs are in their interlocked position, and a concavity 209 in each outermost surface 208. The concavity 209 bounds the complementary portion 29 of the body received in the recess 22, such that in the interlocked position, the outermost surface 208 is substantially aligned coplanar with a respective outer surface 210 of the tip 21 of the hook.

In FIG. 7*a*, it can clearly be seen that both pull tabs 115, 116 are identical and are disposed on the zip fastener facing in opposite directions (180° apart about the longitudinal axis 201) such that their respective tips 21 face one another. The tips 21 of the hooks 21 are aligned transversely with reference to their respective longitudinal axes 201, such that the recesses 22 open transversely.

Figure 8A:
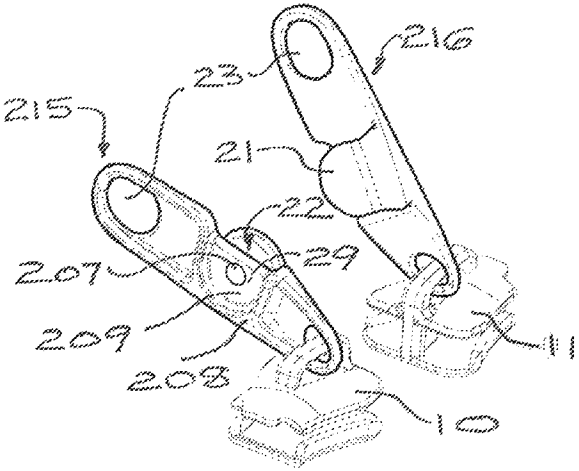
FIGS. 8*a*, 8*b* and 8*c* are pictorial views of a third embodiment of the zip fastener of the invention, showing the pull tabs separated, partially engaged, and interlocked respectively.
Figure 8B:
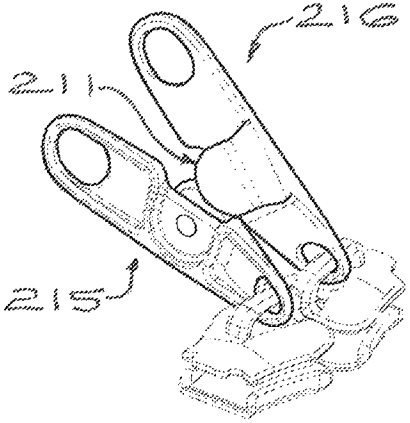
Figure 8C:
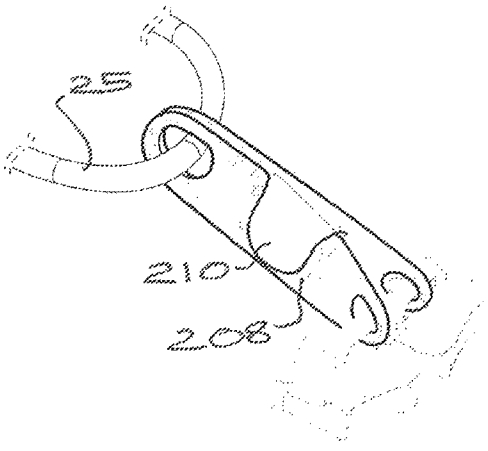

FIGS. 8*a*-8*c* illustrate a third embodiment which is generally like the first embodiment except the shape of the tip 21, which has a generally semi-circular edge 211. A detent for holding the male and female locking features in mutual engagement in the interlocked position (FIG. 8*c*) comprises a permanent magnet 207 received in an aperture in the male locking feature or body portion 29 of each of the pull tabs 215, 216. Each pull tabs 215, 216 has a respective outermost surface 208 disposed outermost when the first and second pull tabs are in their interlocked position, and a concavity 209 in each outermost surface 208. The concavity 209 bounds the complementary portion 29 of the body received in the recess 22, such that in the interlocked position, the outermost surface 208 is substantially aligned coplanar with a respective outer surface 210 of the tip 21 of the hook.

Figure 9:
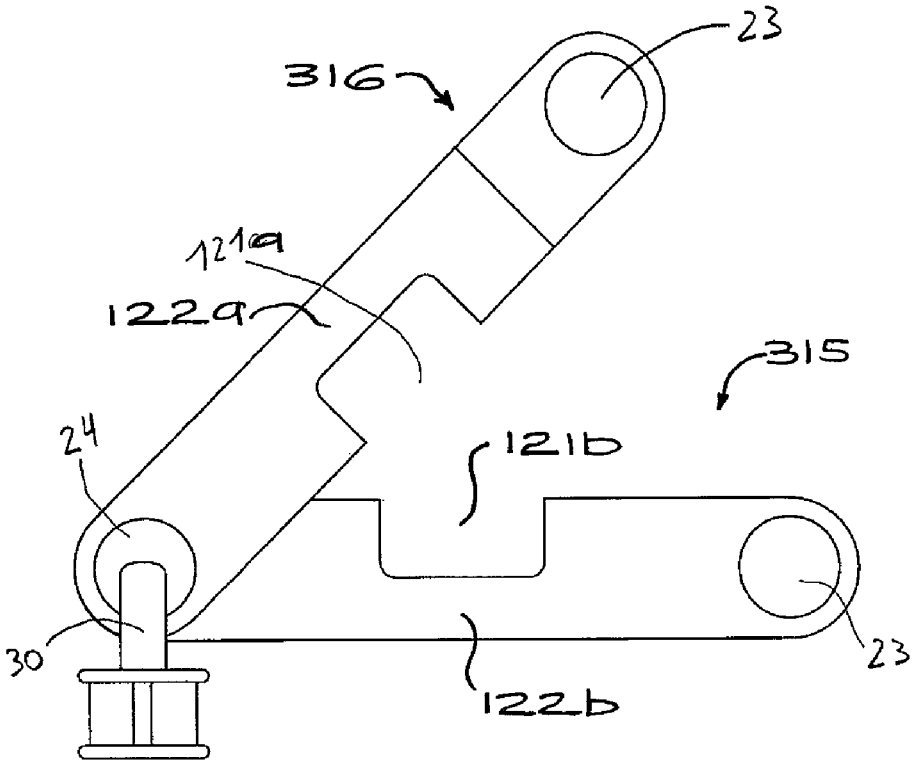
FIG. 9 is a schematic side elevation of a zip fastener of a fourth embodiment of the invention in an open position.
Figure 10:
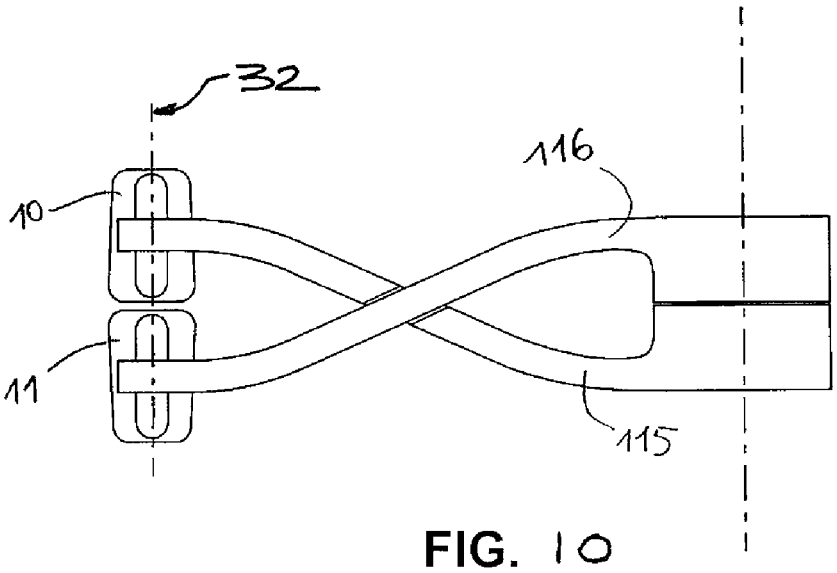
FIG. 10 is a schematic plan view of the zip fastener of FIG. 7 in interlocked position.

A fourth embodiment of a zip fastener is shown in FIGS. 9 and 10 and generally comprises a first pull tab 315 in which a female locking feature in the form of a concavity 121*b* is formed in the body intermediate between its proximal and distal ends, adjacent a male locking feature in the form of body portion 122*b*. Likewise, the second pull tab 316 has a female locking feature in the form of a concavity 121*a* adjacent a male locking feature in the form of body portion 122*a*. The pull tabs 315, 316 are interlocked in like slide-and-turn manner to the first embodiment, firstly sliding the sliders 10, 11 together to the closed position, before rotating one of the pull tabs 315, 316 relative to the other about the pivot axis 32 to mutually engages the male and female locking features, whereupon the second pull tab 316 crosses over from one side to the other of the pull tab 315 and body portion 122*a* is received in the concavity 121*b*, and the body portion 122*b* is received in the concavity 121*a*, to interlock the first and second pull tabs in an interlocked position that prevents movement of the sliders 10, 11 to their open position. Unlike the first embodiment, the pull tabs 315, 316 are different (i.e. right and left-handed).

FIGS. 11-14 illustrate an alternative fastening device 125 for connecting the pull tabs, to a piece of luggage, such as a backpack 35 including the zip fastener 20 and with which fastening device 125 may be employed. The backpack 35 includes a security strap 36 which may be reinforced with metal threads, one longitudinal end of which is fixed to the backpack, as to the shoulder strap 37, and the opposing free end of which may be provided with a loop 38. If it is necessary to leave the backpack 35 the security strap 36 is used to secure it against opportunistic theft by locking around a fixed item such as a post, or a more massive item such as a piece of furniture. The fastening device 125 secures both this strap 36 and the pull tabs 15, 115, 215, 315, 16, 116, 216, 316.

The fastening device 125 may comprise a body 41 formed of a U-shaped bar section 39 to the inside of which is fixed a web 40. Two elongate slots 42, 43 may be provided in the web 40, each slot extending from a respective mouth 46, 47 to a closed end 44, 45, each slot 42, 43 extending adjacent a respective pin portion 48, 49 having a projecting end adjacent the respective mouth 46, 47. A closure 50 may be in the form of a sleeve in which the body 41 is slidingly received for movement between a closed position (FIG. 11) in which the closure 50 closes the mouths 46, 47 and an extended position (FIG. 12) in which the closure 50 opens the mouths 46, 47. In use, with the closure 50 extended, the distal ends of the interlocked pull tabs can be entered through the mouth 46 before pin portion 48 is inserted into the distal end openings 23. The loop 38, or an end fitting on the strap 36, may likewise be entered through the mouth 47 before pin portion 49 is inserted into the loop or end fitting. An aperture 52 in the body 41 may be positioned such that with the closure 50 in the closed position a shackle 53 of a padlock 54 extending through the aperture 52 secures the fastening device 125. Abutments (not shown) may be provided to retain the closure 50 on the body 41.

Figure 15:
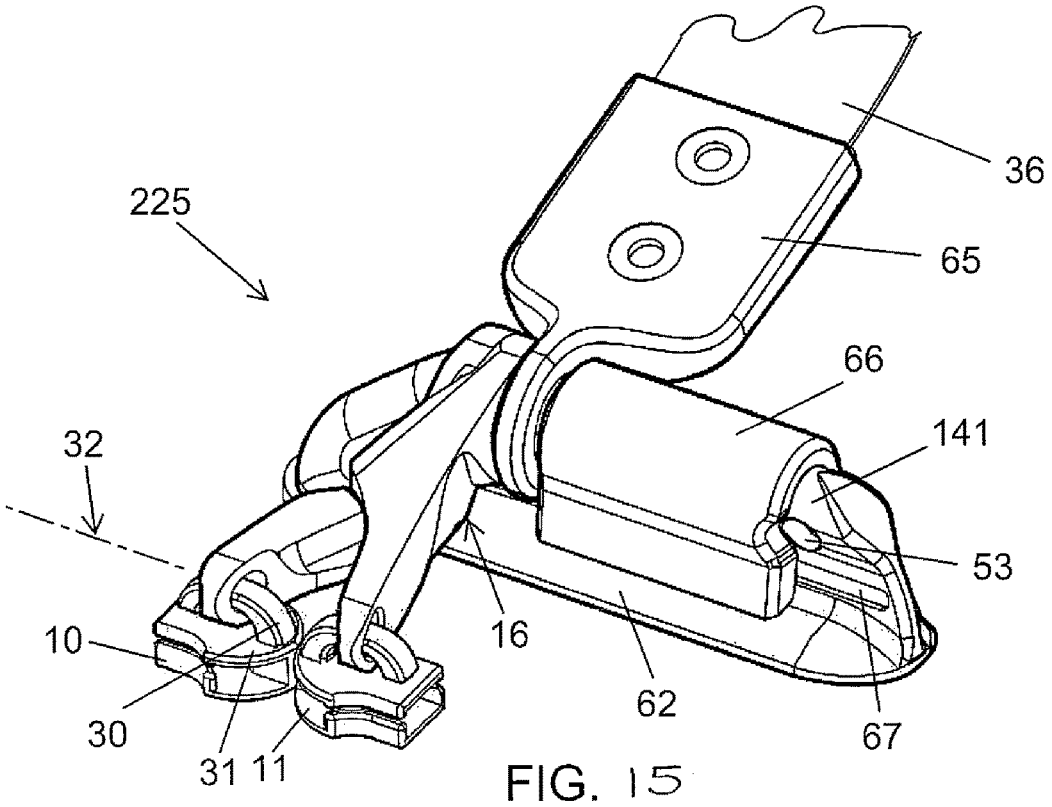
FIG. 15 is a perspective view of a backpack fitted with a zip fastener and a second alternative fastening device of the invention shown in a closed position.
Figure 16:
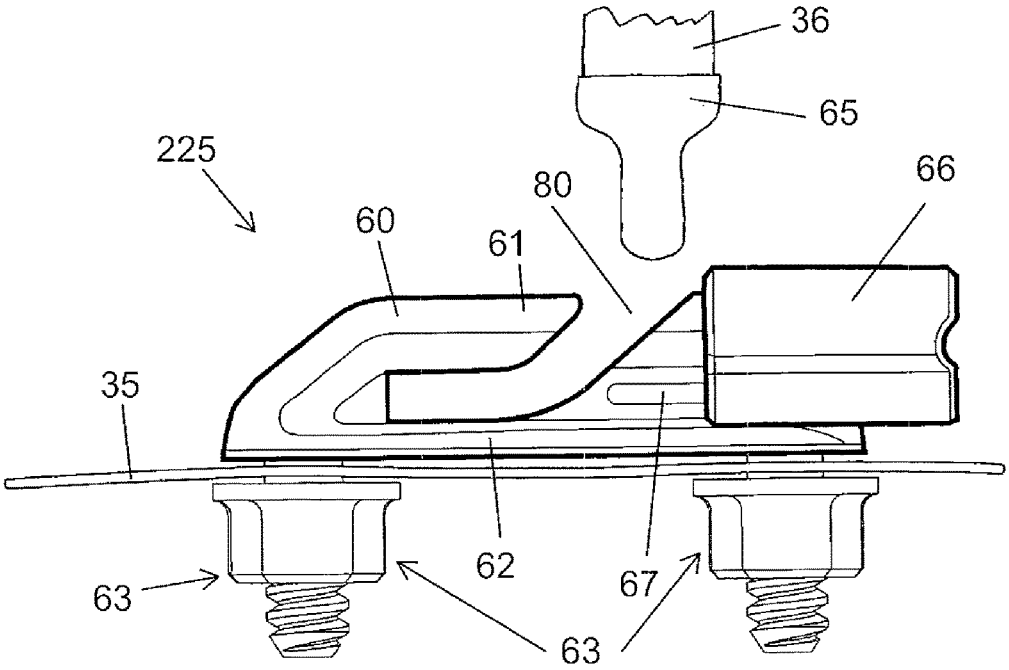
FIG. 16 is a fragmentary sectional view of the second fastening of FIG. 15 in an open position.
Figure 14:
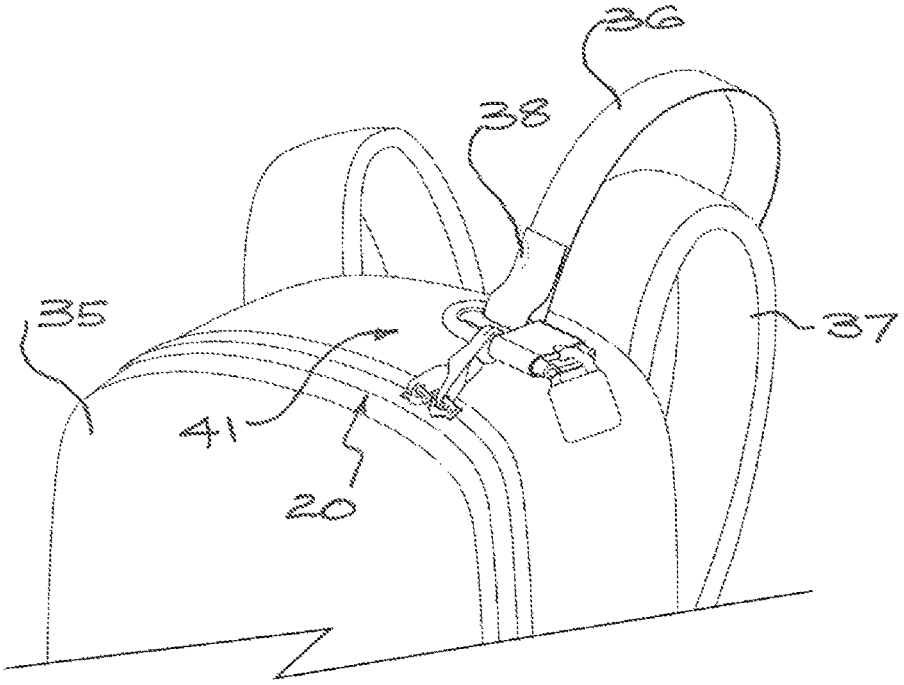
FIG. 14 is a perspective view of a backpack fitted with a zip fastener and a first alternative fastening device of the invention.

FIGS. 15 and 16 illustrate a fastening device 225 fixed to the backpack 35 and adapted for securely connecting both the pull tabs 15, 115, 215, 315, 16, 116, 216, 316 and the strap 36 to the backpack 35 via a single pin portion 60. The free end 61 of the pin portion 60 generally overlies a base member 62 fixed to the backpack 35, as by threaded fasteners 63. Also fixed to the base member 62 is a body section 141 projection next to, but spaced apart from the free end 61, so as to provide a mouth 80 through which the distal ends of the pull tabs and the end fitting 65 on the strap 36 may be entered with the closure 66 in its open position as shown in FIG. 16. The closure 66 may be mounted to the body section 141 to slide in grooves 67 on opposing sides, which may extend generally parallel to the pin portion 60. The closure 66 is shown in its closed, retracted position in FIG. 15, where outward movement may be blocked by a shackle (not shown) extending through an aperture 53 in the body section 141.

Figure 17:
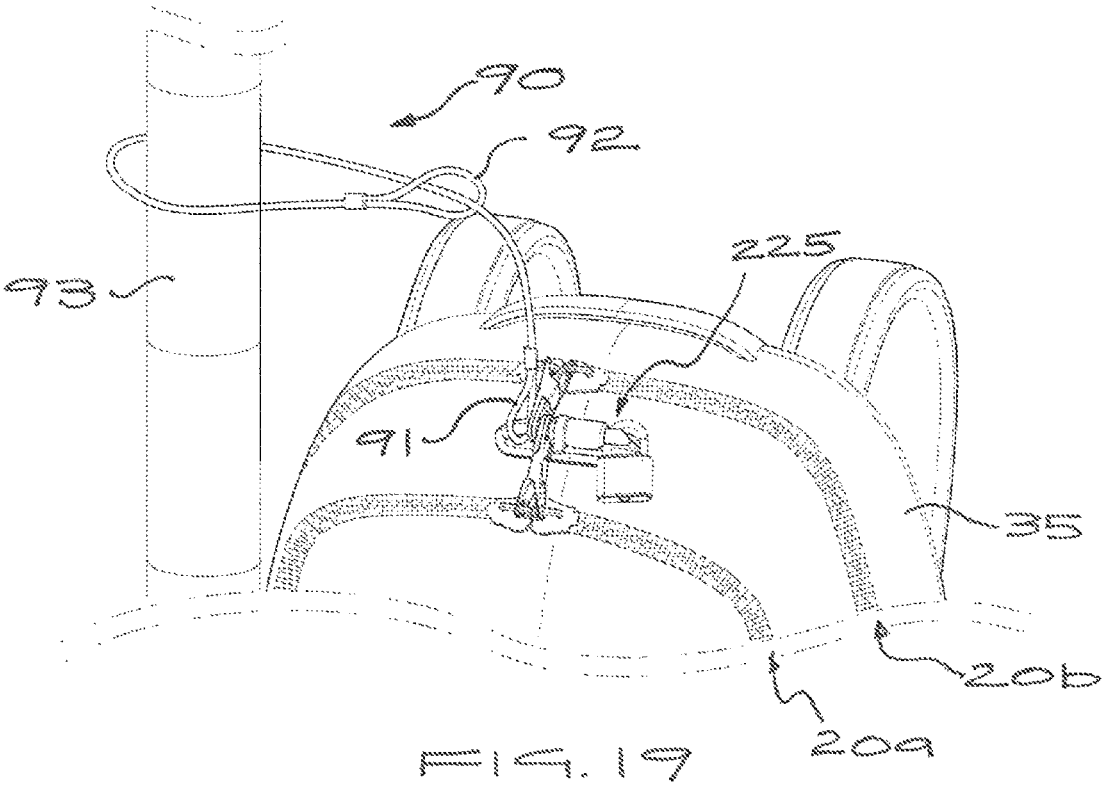
FIG. 17 is a perspective view of a backpack fitted with a zip fastener and a third alternative fastening device of the invention shown in a closed position.
Figure 17:
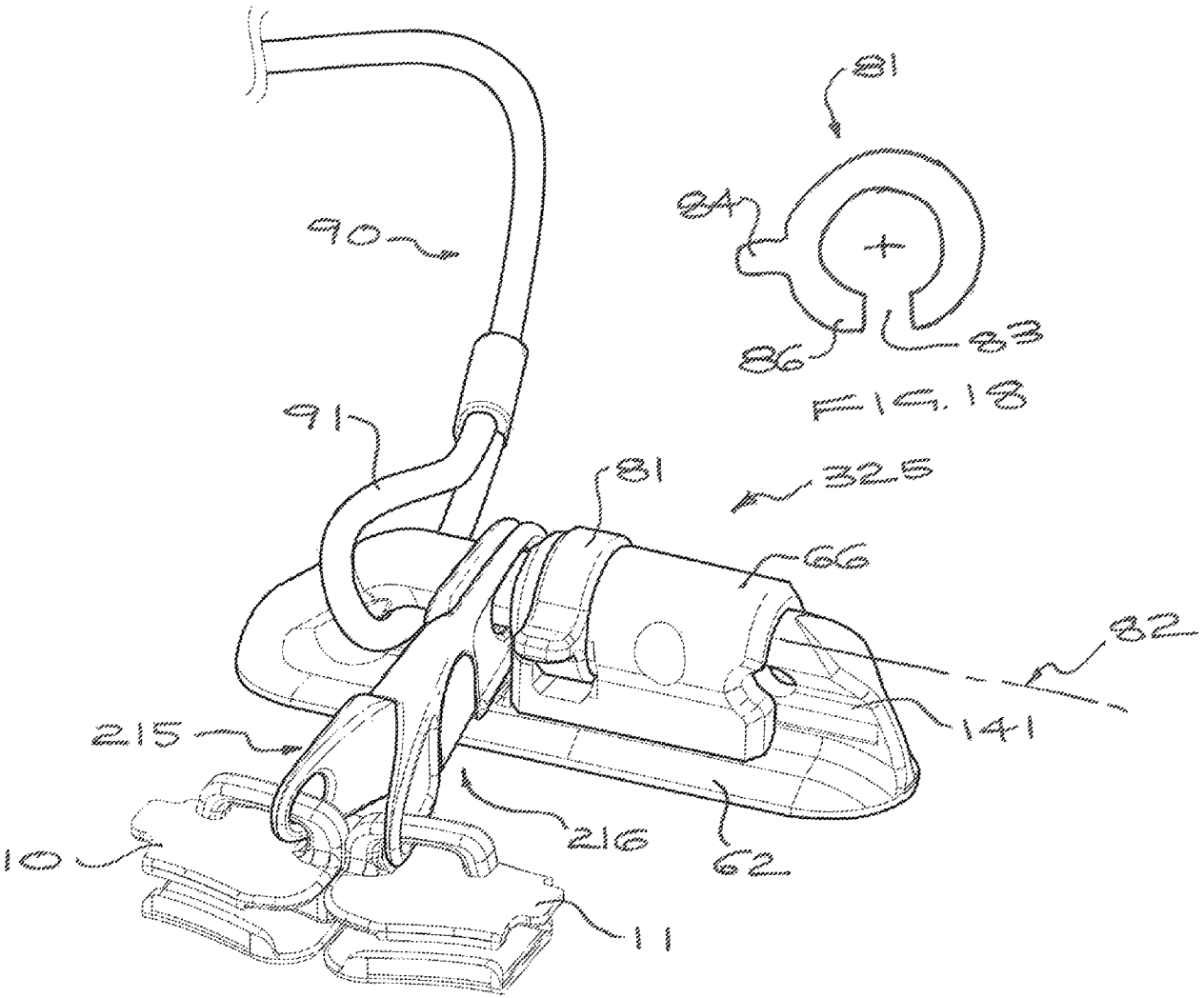

FIGS. 17 to 19 illustrate a fastening device 325 fixed to the backpack 35 between zip fasteners 20*a*, 20*b*, for securing both zip fasteners 20*a*, 20*b* simultaneously. The fastening device 325 has like construction to the fastening device 225, but further includes a latching member 81 carried on the closure 66. The latching member 81 has a penannular form defining a slot 83. A nub 84 projects from its outer surface may be grasped by hand for turning the latching member 81. The latching member 81 is mounted on the closure 66 for rotation about axis 82 between a locked position and an unlocked position, in which the slot 83 is aligned with the body portion 141, allowing the closure 66 to be freely opened and closed. To move the latching member 81 to its locked position the closure 66 is closed or retracted to the position shown in FIG. 17, and the latching member 81 is rotated such that end 86 projects into the mouth 80, blocking movement of the closure 66 to its open position. A security cable 90 having eyes 91 and 92 at opposing ends may be used to secure the backpack 35 to a pole 93 by using the eye 92 to form a loop about the pole 93, and locking the eye 91 in the fastening device 325.

Aspects of the present invention have been described by way of example only and it should be appreciated that modifications and additions may be made thereto without departing from the scope thereof.

The invention claimed is:

1. A zip fastener, comprising:

first and second sliders disposed to slide lengthwise along a pair of stringers, the sliders being moveable relative to one another between a closed position wherein the sliders are adjacent one another, and an open position in which the sliders are spaced apart to open the zip fastener;

first and second pull tabs, each on a respective one of the first and second sliders;

a first coupling connecting the first pull tab to the first slider for rotation about a pivot axis extending substantially in the lengthwise direction of the stringers; and a second coupling connecting the second pull tab to the second slider for rotation about the pivot axis;

the first pull tab having a female locking feature, and the second pull tab having a male locking feature that is complementary to the female locking feature such that with the sliders in the closed position, rotation of the first pull tab about the pivot axis engages the male and female locking features to interlock the first and second pull tabs in an interlocked position that prevents movement of the sliders to the open position, and wherein the first and second pull tabs each have a body elongated between opposing proximal and distal ends, openings are provided in each distal end, and the openings in the distal ends are in registration with one another in the interlocked position.

2. The zip fastener of claim 1 wherein the first pull tab includes a hook disposed between the proximal end and distal end of the first pull tab, a tip of the hook being spaced from the body of the first pull tab such that the female locking feature comprises a recess between the body and the tip of the hook, and wherein the male locking feature comprises a complementary portion of the body of the second pull tab such that the complementary portion of the male locking feature may be received in the recess of the female locking feature.

3. The zip fastener of claim 2 wherein opposing inner surfaces of the recess are substantially planar, and opposing outer surfaces of the complementary portion of the body received in the female locking feature are substantially planar.

4. The zip fastener of claim 3 wherein the first and second pull tabs have bodies of the same length, proximal ends of the same shape and distal ends of the same shape.

5. The zip fastener of claim 2 wherein each pull tab has a respective outermost surface disposed outermost when the first and second pull tabs are in their interlocked position, and a concavity in each outermost surface that bounds the complementary portion of the body received in the recess, such that in the interlocked position, said outermost surfaces are substantially aligned coplanar with a respective outer surface of the tip of the hook.

6. The zip fastener of claim 1 and further comprising:

a first opening formed at a proximal end of the first pull tab;

a second opening formed at a proximal end of the second pull tab;

a first loop on the first slider extending substantially in the lengthwise direction and through the first opening to form the first coupling; and a second loop on the second slider extending substantially in the lengthwise direction and through the second opening to form the second coupling.

7. The zip fastener of claim 2 wherein the tip of the hook is sized or formed such that it cannot mistakenly be inserted into the recess.

8. The zip fastener of claim 2 wherein the first pull tab further includes a flange portion connecting the tip to the body, the flange portion extending from an edge of the body.

9. The zip fastener of claim 1 further comprising a detent for holding the male and female locking features in mutual engagement.

10. The zip fastener of claim 9 wherein the detent comprises a magnet received in an aperture in the male locking feature.

11. Luggage comprising at least one zip fastener as claimed in claim 1, and further including a fastening device for connecting the first and second pull tabs.

12. The luggage of claim 11, wherein the fastening device includes:

a body fixed to the luggage, the body having at least one in portion having a projecting free end and an opposing fixed end, the in portion being configured to be received in the openings in the distal ends of the pull tabs; and a closure engaged with the body for sliding movement between a closed position in which the closure blocks the free end and an open position in which the closure is spaced apart from the free end.

13. The luggage of claim 12 wherein the body further comprises an opening positioned such that with the closure in the closed position, a shackle of a padlock extending through an aperture secures the closure.

14. The luggage of claim 12 wherein the at least one zip fastener comprises two zip fasteners, and the fastening device is fixed to the luggage between the two zip fasteners.

15. A zip fastener comprising:

first and second sliders disposed to slide lengthwise along a pair of stringers, the sliders being moveable relative to one another between a closed position wherein the sliders are adjacent one another, and an open position in which the sliders are spaced apart to open the zip fastener;

first and second pull tabs, each on a respective one of the first and second sliders;

a first coupling connecting the first pull tab to the first slider for rotation about a pivot axis extending substantially in the lengthwise direction of the stringers;

a second coupling connecting the second pull tab to the second slider for rotation about the pivot axis;

a first opening formed at a proximal end of the first pull tab;

a second opening formed at a proximal end of the second pull tab;

a first loop on the first slider extending substantially in the lengthwise direction and through the first opening to form the first coupling; and a second loop on the second slider extending substantially in the lengthwise direction and through the second opening to form the second coupling, the first pull tab having a female locking feature, and the second pull tab having a male locking feature that is complementary to the female locking feature such that with the sliders in the closed position, rotation of the first pull tab about the pivot axis engages the male and female locking features to interlock the first and second pull tabs in an interlocked position that prevents movement of the sliders to the open position.

16. The zip fastener of claim 15 wherein the first pull tab includes a hook disposed between the proximal end and a distal end of the first pull tab, a tip of the hook being spaced from a body of the first pull tab such that the female locking feature comprises a recess between the body and the tip of the hook and the male locking feature comprises a portion on the body complementary to the female locking feature such that the complementary portion of the male locking feature may be received in the recess of the female locking feature, and wherein the tip of the hook is sized or formed such that it cannot mistakenly be inserted into the recess.

17. The zip fastener of claim 16 and further comprising a flange portion connecting the tip to the body, the flange portion extending from an edge of the body.

18. The zip fastener of claim 15 further comprising a detent for holding the male and female locking features in mutual engagement.

19. The zip fastener of claim 18 wherein the detent comprises a magnet received in an aperture in the male locking feature.

20. A zip fastener comprising:

first and second sliders disposed to slide lengthwise along a pair of stringers, the sliders being moveable relative to one another between a closed position wherein the sliders are adjacent one another, and an open position in which the sliders are spaced apart to open the zip fastener;

first and second pull tabs, each on a respective one of the first and second sliders, the first pull tab having a female locking feature and the second pull tab having a male locking feature that is complementary to the female locking feature;

a first coupling connecting the first pull tab to the first slider for rotation about a pivot axis extending substantially in the lengthwise direction of the stringers;

a second coupling connecting the second pull tab to the second slider for rotation about the pivot axis; and a detent for holding the male and female locking features in mutual engagement, the detent comprising a magnet received in an aperture in the male locking feature, wherein when the sliders are in the closed position, rotation of the first pull tab about the pivot axis engages the male and female locking features to interlock the first and second pull tabs in an interlocked position that prevents movement of the sliders to the open position.

* * * * *